United States Patent [19]

Schnetzer

[11] Patent Number: 4,917,580

[45] Date of Patent: Apr. 17, 1990

[54] PUMP MECHANISM FOR SIMULTANEOUS DELIVERY OF TWO ATOMIZER LIQUIDS TO A SPRAYER DEVICE

[75] Inventor: Georg Schnetzer, Mader, Austria

[73] Assignee: Wagner International AG, Switzerland

[21] Appl. No.: 258,012

[22] Filed: Oct. 14, 1988

[30] Foreign Application Priority Data

Oct. 15, 1987 [DE] Fed. Rep. of Germany ..... 3734980

[51] Int. Cl.[4] ..... B05B 12/14; F01B 1/00; F15B 1/00

[52] U.S. Cl. ..... 417/345; 417/429

[58] Field of Search ..... 417/344, 345, 346, 347, 417/429

[56] References Cited

U.S. PATENT DOCUMENTS 4,490,096 12/1984 Box ..... 417/346

FOREIGN PATENT DOCUMENTS 0106586 4/1984 European Pat. Off. .

2312647 9/1974 Fed. Rep. of Germany ..... 417/429

3329296 2/1985 Fed. Rep. of Germany .

*Primary Examiner*—Leonard E. Smith

*Attorney, Agent, or Firm*—Hill, Van Santen, Steadman & Simpson

[57] ABSTRACT

A drive mechanism for controlling pump mechanisms for simultaneous delivery of two atomizer liquids in selectable ratio to a sprayer device comprising two pneumatically actuated piston-cylinder drive mechanisms (air motors comprising reversing valve) and two pumps driven by the piston rods of the air motors. The intake side of each of said pumps is connected to a delivery side which, in turn, is connected to the sprayer device. The piston rods of the air motors are mechanically connected to one another by an adjustable balance arm. Both air motor are respectively provided with two pilot valves that are mechanically actuatable by the motor piston to control the reversing valves of the air motors.

21 Claims, 1 Drawing Sheet

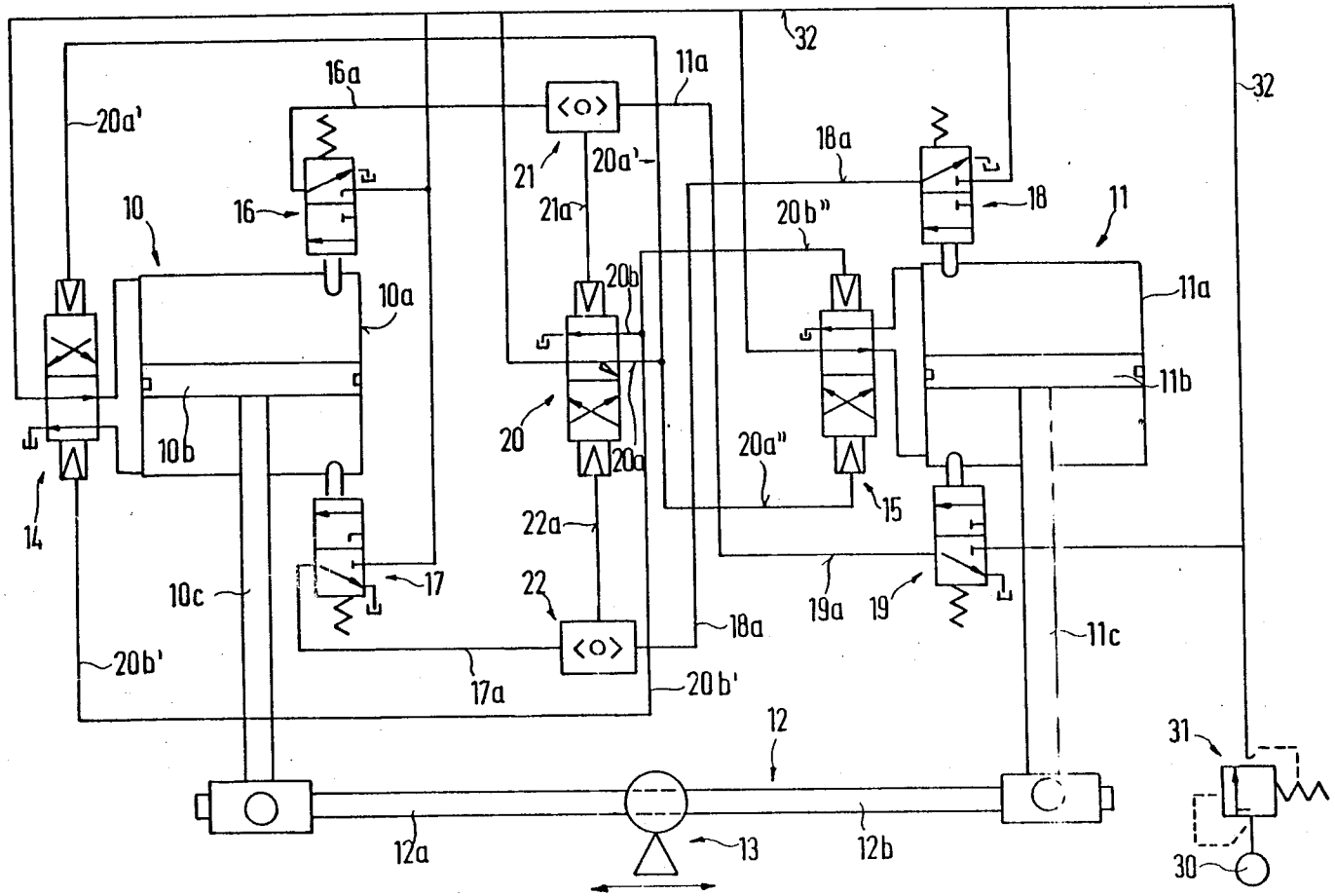
32
11a
11b
11
11c
18
19
15
18a
19a
20b"
20a"
12b
12
13
20b'
20a'
20b
20a
21
21a
22a
22
20
17a
17
10a
16a
16
10b
10c
10
20a'
14
31
30

PUMP MECHANISM FOR SIMULTANEOUS DELIVERY OF TWO ATOMIZER LIQUIDS TO A SPRAYER DEVICE

BACKGROUND OF THE INVENTION

1. Field of the Invention

The present invention relates to a pump mechanism for simultaneous delivery of two atomizer liquids to a sprayer device in which the ratio between the two liquids is selectable to a greater degree than possible in the prior art.

2. Description of the Prior Art

In the pump mechanism for simultaneous delivery of two atomizer liquids to a sprayer device of the type known in the prior art, the piston rods of two paint pumps are driven by the see-saw motion of a balance arm. Two air motors in push-pull operation are utilized to impart the see-saw motion about a displaceable support.

The push-pull operation of the air motors requires a clocked reversing of the two air motors, each in a direction opposite to the other. Such clocked reversing of the two air motors is controlled by two pilot valves whose sensors are situated at the two dead points of the maximum piston stroke positions of one of the two air motors. When the piston of the controlling motor mechanically reaches one of the two dead points, the corresponding sensor forwards a pneumatic control signal to the two reversing valves of the two air motors. Consequently, only one of the two motors controls the pneumatic reversing event of both air motors.

The pump mechanisms in the prior art have means for adjusting the ratio of the atomizer liquids delivered to a sprayer device.

A balance arm connects the two piston rods of the air motors. A displaceable support is used as a fulcrum and placed in the region of the balance beam between the two piston rods. The ratio of the quantity of the two liquids used is controlled by moving the displaceable support in the region between the two piston rods thereby increasing the stroke length of one air motor while decreasing the stroke length of the other. However, given that the two pilot valves whose sensors are situated at the two dead points of the maximum piston stroke are located on one motor, the displacement support may only be moved in the region which increases the stroke length of the piston of the controlling motor. As such, the quantity relationship of the two liquid components can be varied to only a limited degree. The quantity of the liquid component that is conveyed by the pump driven by the controlling air motor must always amount to at least 50%. Such a result is disadvantaged in that a greater degree of flexibility in the adjustment of the ratio between the two liquids is desirable.

SUMMARY OF THE INVENTION

It is therefore an object of the present invention to improve the driven control mechanism controlling a pump mechanism of the type initially set forth such that the quantity relationship between the two liquid components can be arbitrarily modified without thereby deteriorating the precision of the clocked reversing cycle.

The above stated object is inventively achieved in that both air motors are provided with pilot valves having control outputs interconnected and conducted to the control inputs of the two reversing valves. Consequently, the two reversing valves are respectively driven only by the pair of pilot valves that is allocated to the air motor having the greater piston stroke. As such, the balance arm can be adjusted in both directions and any arbitrary quantity relationship of the two liquid components may be selected without thereby disturbing the reversing cycle of the two air motors. In the present invention, both a step-up ratio from 1:1 through 1:10 and a step-down ratio from 1:1 through 0.1:1 may be achieved.

Additionally, the present invention as set forth has an advantage in that an improvement of the definition (amount and duration) of the pneumatic reversing signals is achieved. Such an advantage is obtained by using an additional main reversing valve which directly drives the two reversing valves associated with the air motors.

BRIEF DESCRIPTION OF THE DRAWINGS

Other objects, features, in advantages of the invention will best be understood from the following detailed description taken in conjunction with the accompanying drawing which shows a schematic diagram of the relevant parts of the present invention.

DESCRIPTION OF THE PREFERRED EMBODIMENT

As, the drive mechanism utilizes two pneumatic drive motors 10, 11 each of which is composed of a cylinder 10*a*, 11*a*, a piston 10*b*, 11*b*, and a piston rod 10*c*, 11*c*. The two pistons rods 10*c*, 11*c* are connected to one another via a balance arm 12 having a displaceable support 13. Although not shown in the schematic diagram, the two ends of the balance arm 12 are connected to the piston rods of the two paint pumps to be driven by the air motors 10, 11.

Each of the two motors 10, 11 has a respective pneumatic reversing valve 14, 15. Such reversing valves 14, 15 comprise a compressed air admission, two compressed air outlets, and two control admissions. The control admissions allow the compressed air to be switched from one outlet to the other outlet. The two outlets of the valves 14, 15 discharge into the interior of the allocated cylinder 10*a*, 11*a* respectively. In one cylinder the outlet is placed above the piston while in the other cylinder the output is placed below the piston.

Each of the air motors 10, 11 is equipped with two pilot valves 16, 17 or, respectively, 18, 19. Each pilot valve has a compressed air admission and a compressed air outlet. The passage through the valve is mechanically controlled when the sensor is mechanically pressed by the piston. The sensors of the pilot valves 16, 17, 18, 19 project from the ceiling or, respectively, from the floor of the cylinder 10*a* or, respectively 11*a* into the interior of the cylinder such that the one sensor is mechanically contacted in the one final position of the piston 10*b* and the other sensor is mechanically contacted in the other final position thereof.

The drive mechanism also utilizes a main reversing valve 20 having a structure which is similar to that of the reversing valves 14, 15 in that is has a compressed air admission and two compressed air outlets whose switching is effected by two control inputs.

The drive mechanism also utilizes two alternating valves 21, 22. Each of the alternator valves has two compressed air admissions and one compressed air outlet. In operation, when compressed air arrives at the one admission of the alternating valve the other admission is blocked and vise versa.

A compressed air source 30 supplies compressed air to the inputs of the reversing valves 14, 15, 20 and to the pilot valves 16, 17, 18, 19 via a pressure regulator 31 and a main compressed air line 32. The output lines **16*a*, 17*a*, 18*a*, 19*a* of the four pilot valves 16, 17, 18, 19 are crossed at the inputs of the two alternating valves 21, 22 such that the output line 16*a* of the upper pilot valve 16 of the air motor 10 and the outpput line 19*a* of the lower pilot valve 19 of the air motor 11 are connected to the inputs of the alternating valve 21. Similarly, the output line 17*a* of the lower pilot valve 17 of the air motor 10 and the output line 18*a* of the upper pilot valve 18 of the air motor 11 are connected to the inputs of the alternating valve 22**.

The output lines **21*a*, 22*a* of the two alternating valves 21, 22 are connected to the two control inputs of the main reversing valve 20. The two outputs of the main reversing valve 20 are connected to the control inputs of the two reversing valves 14, 15 such that the one output line 20*a* branches into lines 20*a*' and 20*a*''. Line 20*a*' connects to the upper control admission of the reversing valve 14 and line 20*a*'' connects to the lower control admission of the reversing valve 15**.

In contrast thereto, the second admission **20*b* of the main reversing valve 20 splits into two lines $20_{b'}$ and $20_{b''}$. Line $20_{b'}$ leads to the lower control admission of the reversing valve 14 and line $20_{b''}$ leads to the upper control admission of the reversing valve 15**.

In operation, the reversing valves 14, 15 respectively allocated to the air motors 10, 11 alternately allow compressed air into the cylinder space above the piston **10*b*, or respectively, below the piston 11*b*. The two reversing valves 14, 15** are supplied by the same control line and operate the motors in a push-pull fashion.

Assuming that the displaceable support 13 of the balance arm 12 is displaced towards the left, the balance arm section **12*a* will become shorter than the balance arm section 12*b*. As a result, the stroke of the piston 10*b* is shorter then the stroke of the piston $11_b$. Consequently, given an upward motion of the piston 11*b* and downward motion of the piston $10_b$, piston 11*b* reaches the sensor of its upper pilot valve 18 at a point in time at which the piston 10*a* is still some distance from the sensor of its lower pilot valve 17. When the piston 11*b* mechanically contacts the sensor of the pilot valve 18, the valve is enabled. As such, compressed air flows through the output line 18*a* to the one admission of the alternating valve 22. Given the operation of the alternating valves previously set forth, the other admission of the alternating valve 22 connected to line 17*a* is blocked. Consequently, the compressed air flows from the outlet line 22*a* of the alternating valve 22 to the lower control admission of the main reversing valve 20**.

When the compressed air enters the lower control admission of the main reversing valve 20, the output of the main reversing valve 20 is switched from its one outlet **20*a* to its other outlet 20*b* thereby applying compressed air to the control lines of the two reversing valves 14, 15 via the lines 20*b*' and 20*b*''. As a result thereof, the compressed air proceeds into the cylinders 11*a*** or, respectively, $10_a$ above the piston $10_b$ or below the piston $11_b$ thereby reversing the piston motion.

During the course of its downward motion, the piston $11_b$ again reaches the sensor of its lower pilot valve 19 before the piston **10*b* is capable of reaching the sensor of its upper pilot valve 16. Consequently, the same switching function as set forth above is triggered by the pilot valve 19 via the main reversing valve 20**. However, the switching action reverses the direction of the previous cycle.

As illustrated by the discussion set forth above, the switching is exclusively initiated by the two pilot valves 18, 19 with a displaceable support 13 on the balance beam 12 is displaced to the left. In such operation, the pilot valves 16, 17 are disconnected for the control circulation by the alternating valves 21, 22.

Alternatively, when the displaceable support 13 of the balance arm 12 is displaced toward the right, the arm section **12*a* becomes greater then the arm section 12*b*. Consequently, piston 10*b* mechanically contacts the sensors of the pilot valves 16, 17 before piston 11*b* contacts the sensors of the pilot valves 18, 19. As such, the compressed air of the pilot valves 16, 17 reaches the alternating valves 21, 22 first so that the lines 18*a* and 19*a* are effectively disconnected thereby transferring the control of the main reversing valve 20 and, as a result, of the reversing valves 14, 15, to the pilot valves 16, 17**.

As illustrated, the displaceable support 13 can be arbitrarily displaced toward the right or left. The motor having the respectively greater piston stroke automatically assumes control of the reversing mechanisms thereby removing the limitations which result when the displaceable support has a limited direction of mobility.

In utilizing a main reversing valve 20 and alternating valves 21, 22, exactly defined pneumatic control signals that assure the precision of the pneumatic control are guaranteed. Such precision is of great significance since the two air motors 14, 15 are mechanically connected to one another via the balance arm 12.

Numerous modifications to the preferred embodiment set forth are possible. For example, the alternating valves may be omitted upon condition that the pilot valves are provided with check means which automatically prevent the penetration of compressed air at the output side. Furthermore, the main reversing valve may be omitted and the outputs of the two alternating valves could be conducted directly to control inputs of the two reversing valves. However, such a modification may degrade the integrity of the pneumatic control signals arriving at the reversing valves.

Although modifications and changes may be suggested by those skilled in the art, it is the intension of the inventor to embody within the patent warranted hereon and changes and modifications as reasonably and properly come within the scope of this contribution to the art.

I claim:

1. A drive control system for a multiple pump apparatus producing the simultaneous delivery of multiple atomizer liquids in a selectable ratio comprising:

a first piston-cylinder drive, said first piston-cylinder drive having fluid entry means for allowing entry of a pressurized fluid into the cylinder region above the piston of said first piston-cylinder drive, said pressurized fluid providing means for driving said piston into the lower cylinder region of said first piston-cylinder drive;

a second piston-cylinder drive, said second piston-cylinder drive having fluid entry means for allowing entry of a pressurized fluid into the cylinder region below the piston of said first piston-cylinder drive, said pressurized fluid providing means for driving said piston into the upper cylinder region of said first piston-cylinder drive;

stroke adjustment means attached to the pistons of said piston-cylinder drives for adjusting the respective stroke lengths of said pistons so that an increase in the piston stroke length in one of said piston-cylinder drives produces a corresponding shortening of the piston stroke length in the other of said piston-cylinder drives;

a first pneumatic drive means for actuating said first piston-cylinder drive, said first pneumatic drive means providing a controlled flow of a pressurized fluid into the cylinder region above the piston of said first piston-cylinder drive;

a second pneumatic drive means for actuating said second piston-cylinder drive, said second pneumatic drive means providing a controlled flow of a pressurized fluid into the cylinder region below the piston of said first piston-cylinder drive;

multiple pilot control means respectively connected to each of said piston-cylinder drives, said multiple pilot control means disposed at the dead points of the pistons of said pneumatic drive devices for providing control signals for said pneumatic drive means, said control signals being actuated by contact between the pistons of said piston-cylinder drives and the respective pilot control means;

transfer control means for selecting between the control signal outputs of said multiple pilot means, said transfer control means having inputs connected to the control signal outputs of said multiple pilot means and outputs connected to said pneumatic drive means, said transfer control means providing control signals to said pneumatic drive means, said control signals to said pneumatic drive means corresponding to the output control signals provided by the pilot control means disposed on the piston-cylinder drive having the longer piston stroke;

a compressor means for maintaining a supply of liquid at a constant pressure to said multiple pilot means, said pneumatic drive means, and said transfer control means.

2. A drive control system as recited in claim 1, wherein said stroke adjustment means comprises a balance arm connected between the pistons of said piston-cylinder drives and a displaceable support movably attached to said balance arm between said pistons.

3. A drive control system as recited in claim 1, wherein said first pneumatic drive means comprises a reversing valve receiving control signals from said transfer control means and having an input connected to said compressor means and an output connected to the upper cylinder region above the piston of said first piston-cylinder drive.

4. A drive control system as recited in claim 1, wherein said first pneumatic drive means comrpises a reversing valve receiving control signals from said transfer control means and having an input connected to said compressor means and an output connected to the lower cylinder region below the piston of said first piston-cylinder drive.

5. A drive control system as recited in claim 1, wherein said transfer control means comprises:

a pair of alternating valves having inputs connected to the control signal outputs of the pilot control means;

a main reversing valve having control signal inputs connected to the outputs of said alternating valves, an input connected to said compressor means and outputs supplying control signals to said pneumatic drive means.

6. A drive control system as recited in claim 1, wherein the transfer control means comprises a pair of alternating valves having inputs connected to the control signal outputs of said multiple pilot control means, said pair of alternating valves also having outputs connected to the control signal inputs of said first and second pneumatic drive means.

7. A drive control system as recited in claim 1, wherein said multiple pilot control means comprises;

a first pilot valve connected to the upper cylinder region of said first piston-cylinder drive for contacting the piston of said first piston-cylinder drive when the piston of said first piston-cylinder drive reaches an upper dead position, said first pilot valve having an input connected to said compressor means and an output signal connected to said transfer means as one of said control nputs to said transfer control means;

a second pilot valve connected to the lower cylinder region of said first piston cylinder drive for contacting the piston of said first piston-cylinder drive when the piston of said first piston-cylinder drive reaches a lower dead position, said second pilot valve having an input connected to said compressor means and an output signal connected to said transfer means as one of said control inputs to said transfer control means;

a third pilot valve connected to the upper cylinder region of said second piston-cylinder drive for contacting the piston of said second piston-cylinder drive when the piston of said second piston-cylinder drive reaches an upper dead position, said third pilot valve having an input connected to said compressor means and an output signal connected to said transfer means as one of said control inputs to said transfer control means;

a fourth pilot valve connected to the lower cylinder region of said second piston-cylinder drive for contacting the piston of said second piston-cylinder drive when the piston of said second piston-cylinder drive reaches a lower dead position, said fourth pilot valve having an input connected to said compressor means and an output signal connected to said transfer means as one of said control inputs to said transfer control means.

8. A drive control means as recited in claim 7, wherein said transfer control means comprises:

a first alternating valve having a first input connected to the output of said first pilot valve and a further input connected to the output of said fourth pilot valve;

a second alternating valve having a first input connected to the output of said second pilot valve and a further input connected to the output of said third pilot valve, said second alternating valve having an output representative of the input signal occuring first in time;

a main reversing valve having a first control input connected to the output of said first alternating valve and a further control input connected to the output of said second alternating valve and outputs connected to said pneumatic drive means.

9. A drive control system for a multiple pump apparatus producing the simultaneous delivery of multiple atomizer liquids in a selectable ratio comprising:

a first piston-cylinder drive, said frist piston-cylinder drive having fluid entry means for allowing entry of a pressurized fluid into the cylinder region above the piston of said first piston-cylinder drive, said pressurized fluid providing means for driving said piston into the lower cylinder region of said first piston-cylinder drive;

a second piston-cylinder drive, said second piston-cylinder drive having fluid entry means for allowing entry of a pressurized fluid into the cylinder region below the piston of said first piston-cylinder drive, said pressurized fluid providing means for driving said piston into the upper cylinder region of said first piston-cylinder drive;

a first pair of pilot control means disposed on said first piston cylinder drive for providing control signal outputs indicative of the piston position in said first piston-cylinder drive;

a second pair of pilot control means disposed on said second piston cylinder drive for providing control signal outputs indicative of the piston position in said second piston-cylinder drive;

stroke adjustment means attached to the pistons of said piston-cylinder drives for adjusting the respective stroke lengths of said pistons so that an increase in the piston stroke length in one of said piston-cylinder drives produces a corresponding shortening of the piston stroke length in the other of said piston-cylinder drives;

a transfer control means for selecting between the control signal outputs of said first pair of pilot means and said second pair of pilot means, said transfer control means having inputs connected to the control signal outputs of said first and second pair of pilot means, said transfer control means having outputs corresponding to the inputs to said transfer control means provided by the pair of pilot control means disposed on the piston-cylinder drive having the longer piston storke;

a first pneumatic drive means for actuating said first piston-cylinder drive, said first pneumatic drive means providing a controlled flow of a pressurized fluid into the cylinder region above the piston of said first piston-cylinder drive, said first pneumatic drive means having control signal inputs connected to the outputs of said transfer control means for placing said first pneumatic drive means under the control of the control signals corresponding to the outputs of the pair of pilot control means disposed on the piston-cylinder drive having the longer piston stroke;

a second pneumatic drive means for actuating said second piston-cylinder drive, said second pneumatic drive means providing a controlled flow of a pressurized fluid into the cylinder region below the piston of said second piston-cylinder drive, said second pneumatic drive means having control signal inputs connected to the outputs of said transfer control means for placing said second pneumatic drive means under the control of the control signals corresponding to the outputs of the pair of pilot control means disposed on the piston-cylinder drive having the longer piston stroke; and, a compressor means for maintaining a supply of liquid at a constant pressure to said multiple pilot means, said pneumatic drive means, and said transfer control means.

10. A drive control system as recited in claim 9, wherein said stroke adjustment means comrpises a balance arm connected between the pistons of said piston-cylinder drives and a displaceable support movably attached to said balance arm between said pistons.

11. A drive control system as recited in claim 9, wherein said first pneumatic drive means comrpises a downward direction reversing valve receiving actuating control signals from said transfer control means and having an input connected to said compressor means and an output connected to the upper cylinder region above the pistons of said first piston-cylinder drive.

12. A drive control system as recited in claim 9, wherein said second pneumatic drive means comprises an upward direction reversing valve receiving actuating control signals from said transfer control means and having an input connected to said compressor means and an output connected to the lower cylinder region below the piston of said first piston-cylinder drive.

13. A drive control system as recited in claim 9, wherein said first pair of pilot control means comprises;

a first pilot valve connected to the upper cylinder region of said first piston-cylinder drive for contacting the piston of said first piston-cylinder drive when the piston of said first piston-cylinder drive reaches an upper dead position, said first pilot valve having an input connected to said compressor means and an output signal connected to said transfer means as one of said control inputs to said transfer control means; and, a second pilot valve connected to the lower cylinder region of said first piston cylinder drive for contacting the piston of said first piston-cylinder drive when the piston of said first piston-cylinder drive reaches a lower dead position, said second pilot valve having an input connected to said compressor means and an output signal connected to said transfer means as one of said control inputs to said transfer control means.

14. A drive control system as recited in claim 9, wherein said transfer control means comprises:

a pair of alternating valves having inputs connected to the control signal outputs of said first and second pair of pilot control means;

a main reversing valve having control signal inputs connected to the outputs of said alternating valves, an input connected to said compressor means and outputs supplying control signals to said first and second pneumatic drive means.

15. A drive control system as recited in claim 9, wherein said transfer control means comprises a pair of alternating valves having inputs connected to the control signal outputs of said first and second pair of pilot control means, said alternating valves also having outputs connected to the control signal inputs of said first and second pneumatic drive means.

16. A drive control system for a multiple pump apparatus producing the simultaneous delivery of multiple atomizer liquids in a selectable ratio comprising:

first and second piston-cylinder drives each having a piston and a cylinder;

stroke adjustment means attached to the pistons of said piston-cylinder drives for adjusting the respective stroke lengths of said pistons so that an increase in the piston stroke length in one of said piston-cylinder drives produces a corresponding shortening of the piston stroke length in the other of said piston-cylinder drives;

pneumatic drive means for independently actuating said piston-cylinder drives, said pneumatic drive means having first and second reversing valves each having a fluid input and a fluid output and each accepting actuating control signals;

pilot control means respectively connected to each of said piston-cylinder drives for providing control signals for said pneumatic drive means in response to the movements of the pistons of said piston-cylinder drives;

transfer control means for placing said pneumatic drive means under control of the control signals sent by the pilot control means associated with the piston-cylinder drive having the larger piston stroke, said transfer control means having outputs supplying said actuating control signals to said first and second reversing valves;

a compressor means for maintaining a supply of liquid at a constant pressure to said pilot control means, said pneumatic drive means, and said transfer control means;

said fluid input of said first reversing valve connected to said compressor means and said fluid output of said first reversing valve connected to an upper cylinder region above the piston of said first piston-cylinder drive for actuating said first piston-cylinder drive;

said fluid input of said second reversing valve connected to said compressor means and said fluid output of said second reversing valve connected to a lower cylinder region below the piston of said second piston-cylinder drive for actuating said second piston-cylinder drive.

17. A drive control system as recited in claim 16, wherein said transfer control means comprises:

a pair of alternating valves having inputs connected to control signal outputs of said pilot control means;

a main reversing valve having control signal inputs connected to outputs of said alternating valves, an input connected to said compressor means and outputs connected said pneumatic drive means as said actuating control signals.

18. A drive control system as recited in claim 16, wherein said transfer control means comrpises a pair of alternating valves having inputs connected to control signal outputs of said pilot control means and outputs connected to control signal inputs of said pneumatic drive means.

19. A drive control system as recited in claim 16, wherein said stroke adjustment means comprises a balance arm connected between the pistons of said piston-cylinder drives and a displaceable support movably attached to said balance arm in a region of said balance arm between said pistons.

20. A drive control system as recited in claim 16, wherein said pilot control means comprises:

a first pilot valve connected to said upper cylinder region of said first piston-cylinder drive for contacting the piston of said first piston-cylinder drive when the piston of said first piston-cylinder drive reaches an upper dead position, said first pilot valve having an input connected to said compressor means and an output signal connected to said transfer control means;

a second pilot valve connected to a lower cylinder region of said first piston cylinder drive for contacting the piston of said first piston-cylinder drive when the piston of said first piston-cylinder drive reaches a lower dead position, said second pilot valve having an input connected to said compressor means and an output signal connected to said transfer means;

a third pilot valve connected to an upper cylinder region of said second piston-cylinder drive for contacting the piston of said second piston-cylinder drive when the piston of said second piston-cylinder drives reaches an upper dead position, said third pilot valve having an input connected to said compressor means an output signal connected to said transfer means as one of said control inputs to said transfer control means;

a fourth pilot valve connected to said lower cylinder region of said second piston-cylinder drive for contacting the piston of said second piston-cylinder drive when the piston of said second piston-cylinder drive reaches a lower dead position, said fourth pilot valve having an input connected to said transfer control means.

21. A drive control means as recited in claim 20, wherein said transfer control means comprises:

a first alternating valve having a first input connected to the output of said first pilot valve and further input connected to the output of said fourth pilot valve said first alternating valve having an output representative of the input signal occurring first in time;

a second alternating valve having a first input connected to the output of said second pilot valve and a further input connected to the output of said third pilot valve said second alternating valve having an output representative valve having an output representative of the input signal occurring first in time;

a main reversing valve having a first control input connected to the output of said first alternating valve and a further control input connected to the output of said second alternating valve and outputs connected to said pneumatic supply means representative of the pilot control signals connected with the piston-cylinder drive having the longer piston stroke.

* * * * *